US005713805A

United States Patent [19]

Scher et al.

[11] Patent Number: 5,713,805

[45] Date of Patent: Feb. 3, 1998

[54] BASEBALL PRACTICE DEVICE

[76] Inventors: Steven L. Scher, 24 Imperial Ave., Westport, Conn. 06880; Robert Moss, P.O. Box 486, New Canaan, Conn. 06840; Stephen V. Boccieri, Jr., 233 Elmwood Rd., South Salem, N.Y. 10590

[21] Appl. No.: 281,251

[22] Filed: Jul. 29, 1994

Related U.S. Application Data

[63] Continuation-in-part of Ser. No. 139,989, Oct. 21, 1993, Pat. No. 5,374,065.

[51] Int. Cl.[6] ..... A63B 69/40

[52] U.S. Cl. ..... 473/426

[58] Field of Search ..... 273/26 E, 26 R, 273/29 A, 185 C, 184 B, 196, 197 R, 197 A, 198, 200 R, 413, 414, 411

[56] References Cited

U.S. PATENT DOCUMENTS

| | | | |
|---|---|---|---|
| 1,240,198 | 9/1917 | Guthrie | 273/185 C |
| 2,219,735 | 10/1940 | Armstrong | 273/26 E |
| 3,310,306 | 3/1967 | Burt | 273/26 E |
| 3,397,885 | 8/1968 | Nash | 273/26 E |
| 3,442,510 | 5/1969 | Sorensen | 273/26 E |
| 3,623,725 | 11/1971 | Setten | 273/26 E |
| 3,893,669 | 7/1975 | Myers | 273/29 A |
| 4,079,934 | 3/1978 | Nixon | 273/29 A |
| 4,191,372 | 3/1980 | Keller | 273/29 A |
| 4,216,960 | 8/1980 | Nicholls | 273/29 A |
| 4,674,744 | 6/1987 | Walsh | 273/26 E |
| 4,706,964 | 11/1987 | Genovese | 273/26 E |
| 4,986,551 | 1/1991 | Langlois | 273/580 |
| 5,282,615 | 2/1994 | Green | 273/29 A |
| 5,338,026 | 8/1994 | Kregel | 273/26 E |

FOREIGN PATENT DOCUMENTS

| | | | |
|---|---|---|---|
| 240652 | 6/1925 | United Kingdom | 273/29 A |

*Primary Examiner*—Theatrice Brown
*Attorney, Agent, or Firm*—Grimes & Battersby

[57] ABSTRACT

A baseball practice device in which a baseball is releasably attached to a "Y" shaped tether system which, in turn, is supported by two horizontal arms arranged in a "Y" shaped configuration. The combination of the horizontal arms and the tether system allows simulation of a pitching environment where the baseball may be presented to the batter with a uniform and repeatable flight path to enhance batting practice.

20 Claims, 7 Drawing Sheets

BASEBALL PRACTICE DEVICE

CROSS-REFERENCE TO RELATED APPLICATIONS

This is a continuation-in-part of application Ser. No. 08/139,989 filed Oct. 21, 1993 (U.S. Pat. No. 5,374,065).

FIELD OF THE INVENTION

This invention relates generally to sport training devices and/or toys and, more particularly, to a baseball practice device suitable for use by children or adults.

BACKGROUND OF THE INVENTION

Baseball is America's favorite sporting event and also has wide popularity in other areas of the world including Japan, Taiwan and South America. Numerous organizations exist in the U.S., and around the world, which function to introduce the sport to children, and extensive efforts are employed on a world-wide basis in teaching young children the skills necessary to play the game of baseball.

One of the most important skills required is the ability to hit the baseball, which often necessitates extensive practice, particularly for young players just learning the sport.

A device often used for teaching young players the skill of hitting the baseball is the "Tee-Ball" approach, in which a baseball is placed on top of a support structure situated directly in front of the batting position. The player then swings the bat at the baseball (a stationary target) and thereby begins to develop the batting skills necessary for success in playing baseball. For a very young player just learning the game, the Tee-Ball approach has merit.

However, the drawback with the Tee-Ball approach is that the baseball is stationary and therefore does not give the player practice swinging at a moving object. Hitting a moving object is critical for success in the game of baseball, and the Tee-Ball approach does not provide the necessary practice skills to achieve this result. A current alternative, of course, is for a pitcher to pitch to the player but this technique often is unsatisfactory, as it depends on the skill and patience of the pitcher. More importantly, each pitch does not present a uniform flight path for the baseball and, therefore, the player, particularly the young player, still has difficulty hitting the ball due to the variation in the flight path for each pitch.

A second alternative is the use of mechanical pitching devices, but these devices are extremely expensive, difficult to use, and can be dangerous for young players due to the speed of the ball being pitched.

It is, therefore an object of the instant invention to provide a batting practice device that is inexpensive, that provides a uniform flight path for the baseball when the baseball is released for batting practice, and is easy to use.

Various prior art patents exist which attempt to provide a batting practice device in which a ball is tethered or suspended in various ways to simulate a pitching environment. One such device is described in U.S. Pat. No. 3,301,556 granted to R. M. Hamilton, Jr., et al on Jan. 31, 1967. The batting practice device described in this patent consists of an overhanging cone-like structure with means to hold a tethered ball in position to be struck by a bat. The ball holding device releasably holds the ball so that the batter may practice swings for striking a ball, whether at rest or moving in a flight path to a designated position. The ball holding structure is adjustable as to height and front-to-back arrangement as well as adjustable to bring the ball down to a desired elevation above the batting position.

A second such device is shown in U.S. Pat. No. 3,716,235 granted to John W. Yerkio, Jr. on Feb. 13, 1973. This device consists of an elongated support structure including a pair of parallel, co-planer support arms between which is connected a cross arm. A tether is suspended from the cross arm and the baseball is releasably connected to the tether to permit the batter to strike the baseball.

Similar devices are shown in U.S. Pat. Nos. 3,397,885, 3,454,275, 3,529,823, 3,893,699, 4,830,372, 4,898,385, 5,048,828 and 5,098,094.

The problem with all of the foregoing batting practice devices is that the tethered ball does not return in a uniform flight path to the batter when the ball is raised in elevation and released for the batter. This result stems from the fact that the ball is generally suspended from a single tether so that when the ball is released to the batter, the flight path will vary, thereby making it much more difficult for the batter to effectively hit the baseball.

It is therefore a further object of the instant invention to provide a batting practice device that produces a uniform flight path for the baseball when released for a swing by the batter.

It is a still further object of the instant invention to provide a batting practice device which accurately simulates a pitching environment by suspending the ball in such a way that it will accurately return to the batter upon each occasion of presenting the ball to the batter for batting practice.

SUMMARY OF THE INVENTION

In accordance with the instant invention, a batting practice device is provided which includes a base element, an upstanding vertical element releasably affixed to the base element and a horizontal element releasably affixed to a top portion of the vertical element.

It is a feature of the invention that the horizontal element has two horizontal extending arms in a "Y" shaped arrangement from which is suspended a tether having first and second upper portions connected to each of said horizontal extending arms and a lower portion from which a baseball is releasably attached.

It is a further feature of the invention that the baseball can either be struck from a stationary position or can be elevated and released by a batting assistant so that the "Y" shaped horizontal extending arms and tether will ensure a uniform flight path upon return of the baseball to the batter.

It is a further feature of the invention that both the upstanding vertical element and the horizontal extending arms are adjustable in height and length, respectively.

It is a further feature of the invention that the flight path of this ball can be varied such that a "curve" or "screwball" pitch can be presented to the batter.

Other objects and features of the present invention will become apparent upon reading the following specification and referring to the accompanying drawings, which form a material part of this invention.

DETAILED DESCRIPTION OF THE DRAWINGS

Figure 1:
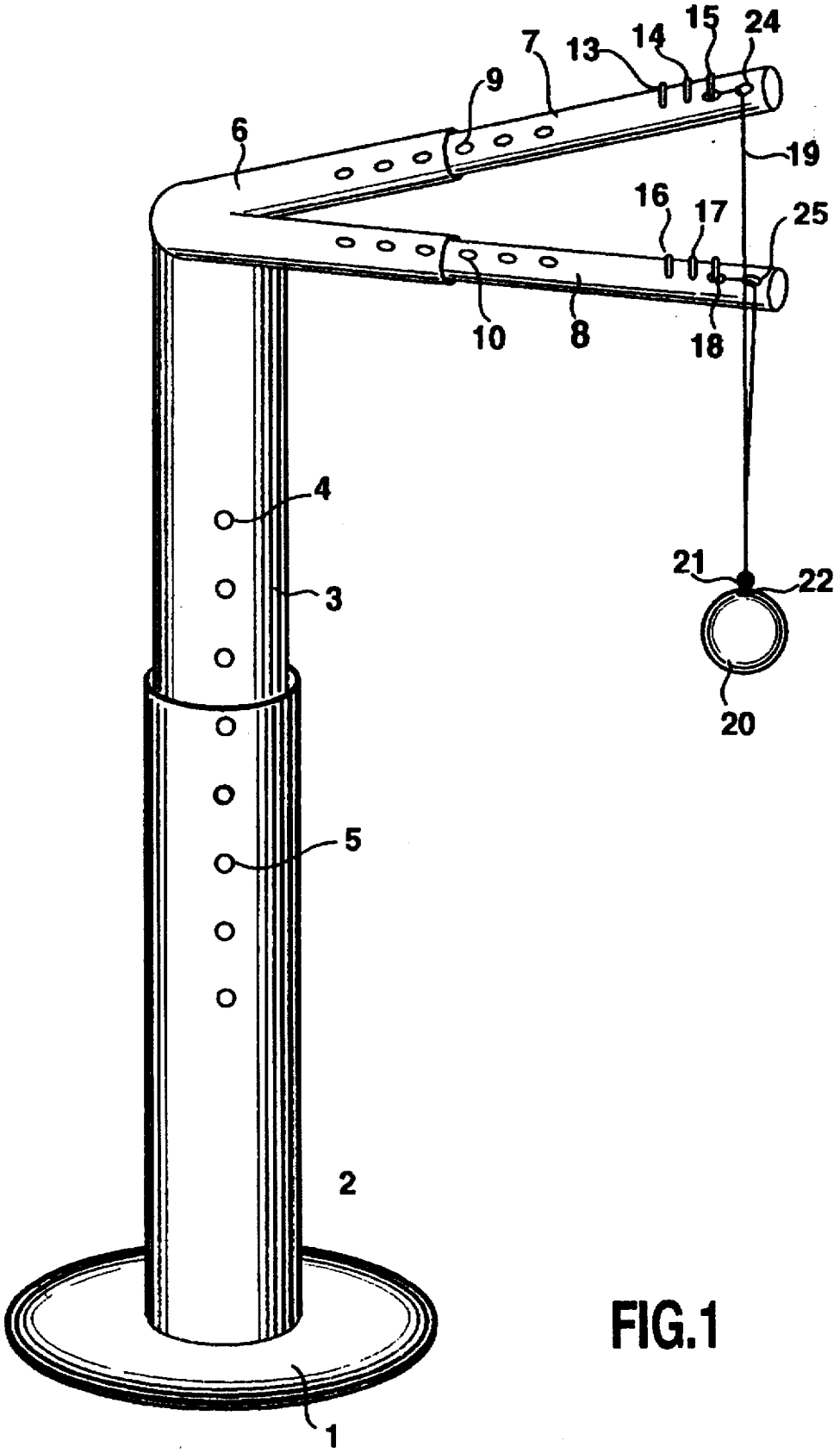
FIG. 1 illustrates a side view of the baseball practice device of the instant invention.

Referring now to FIG. 1, there is shown the batting practice device of the instant invention. The device consists of base 1, vertical members 2 and 3, and horizontal members 6, 7 and 8. Vertical member 2 is affixed to base 1, preferably by a screw type arrangement in which vertical member 2 is screwed into base 1. However, it is understood that various other means of connecting vertical member 2 to base 1 can be employed. Vertical member 3 is smaller in diameter than vertical member 2 and is arranged such that the vertical height of the batting practice device can be adjusted by member 3 sliding within member 2. Securing member 3 to member 2 can be done by affixing securing pins within the holes provided in the vertical members, such as holes 4 and 5.

Horizontal member 6 is a Y-shaped member which is affixed to the top of vertical member 3. It is, of course, understood that member 6 can be affixed to member 3 in a number of ways, but preferably it would rest within member 3 and be secured by various fastening means known to one skilled in the art. Members 7 and 8 are arranged to fit within the hollow arms of member 6. Members 7 and 8 can be adjusted in length by sliding those members within the Y-shaped portion of member 6. Again, members 7 and 8 are secured to the Y-shaped portion of member 6 by placing securing pins or other fastening means within holes 9 and 10.

Attached to the outboard portion of members 7 and 8 is a Y-shaped tether 19 which is threaded through apertures 24 and 25 at the ends of members 7 and 8. The tether is then attached to pins 13, 14 and 15, or 16, 17 and 18, in any suitable manner such that the vertical distance between the ball and the batter can be adjusted to compensate for the height of individual players who will be using the batting practice device.

Cord 19 has affixed on the lower end of an attachment point 21, a suitable fastening material, preferably a hook and loop fastener material, such as Velcro. Ball 20, for use with the batting practice device, also has attached on the top thereof a similar fastening material, again, preferably a hook and loop fastening material 22, which will attach to fastening point 21. It is understood that cord 19 can be a standard rope, or could consist of "bungy" cords, for example, to provide additional flexibility when using the batting practice device.

Figure 2:
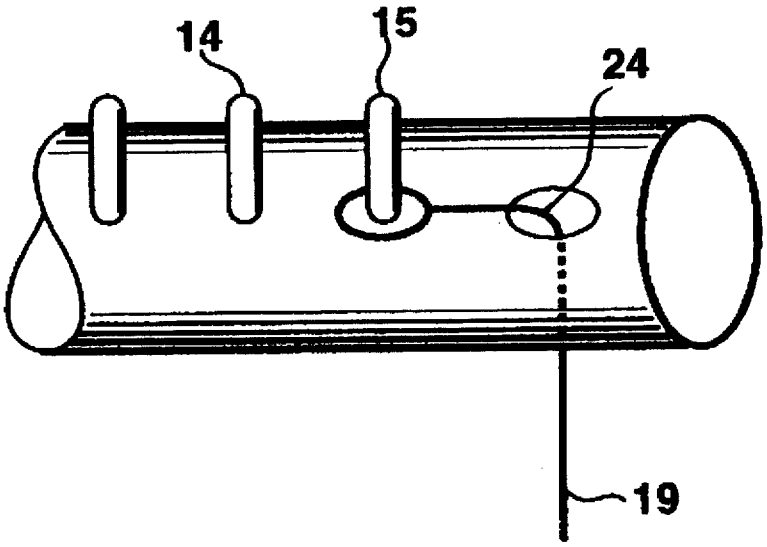
FIG. 2 illustrates the manner in which a tether is attached to the baseball practice device.

FIG. 2 illustrates in greater detail the manner in which tether 19 is attached to pin 15 after being passed through aperture 24.

Figure 3:
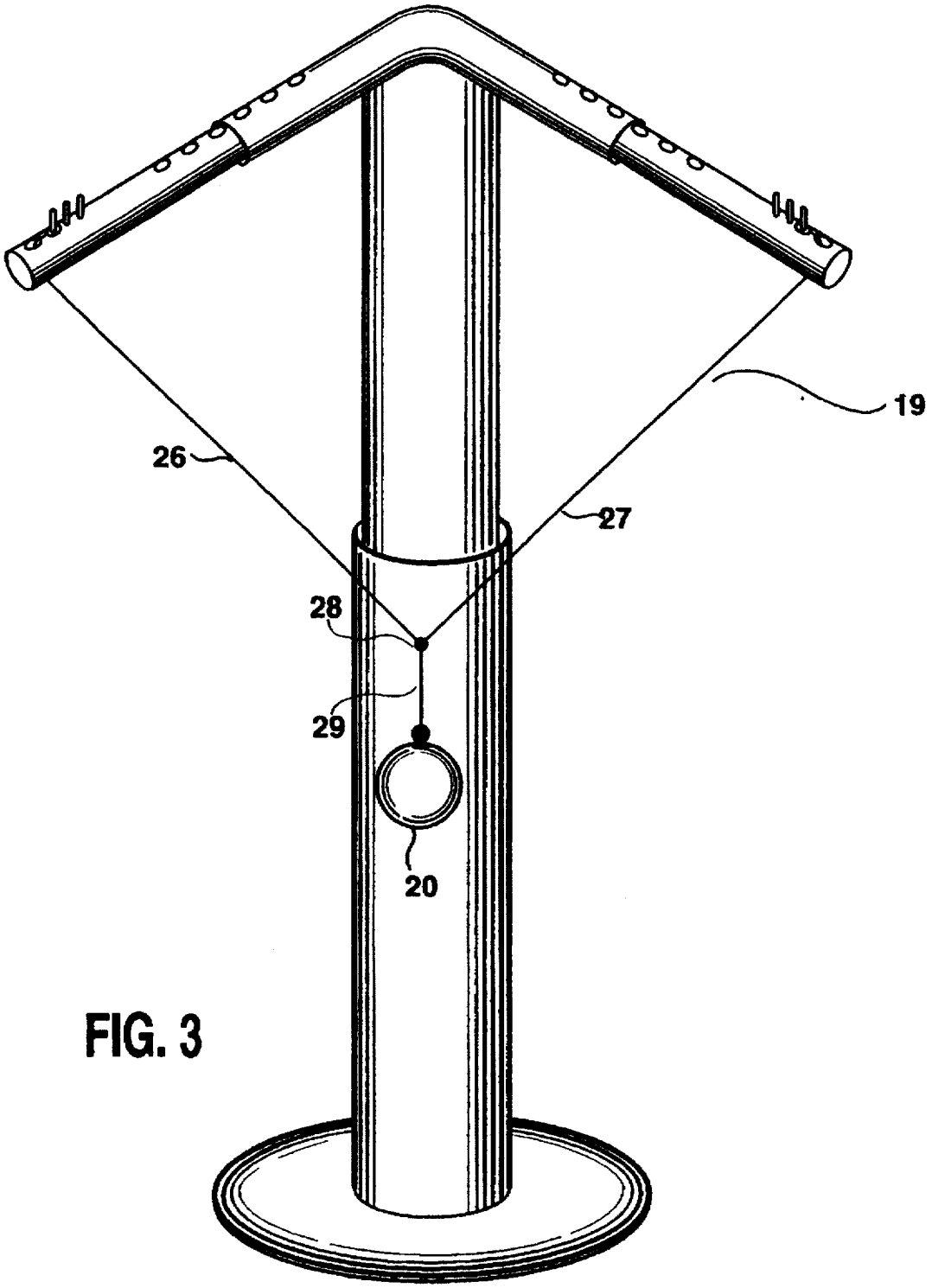
FIG. 3 illustrates a front view of the baseball practice device of the instant invention.

FIG. 3 shows a front view of the batting practice device, which illustrates the fact that the ball 20 is suspended in a Y-shaped tether 19, such that the ball 20 will be situated precisely in front of the batting practice device. In operation, the player may strike ball 20 in a stationary position as it hangs from cord 19. Alternatively, it is possible for the player, or a player assistant, to swing ball 20 in an arc away from the batter, allowing the ball 20 to return on the same arc, thereby allowing the batter to strike at a moving object which will always return on the same flight path to the batter due to Y-shaped tether 19 and Y-shaped arms 7 and 8. Tether 19 consists of two sections 26 and 27 connected at connection point 28 with a third section 29.

Figure 4:
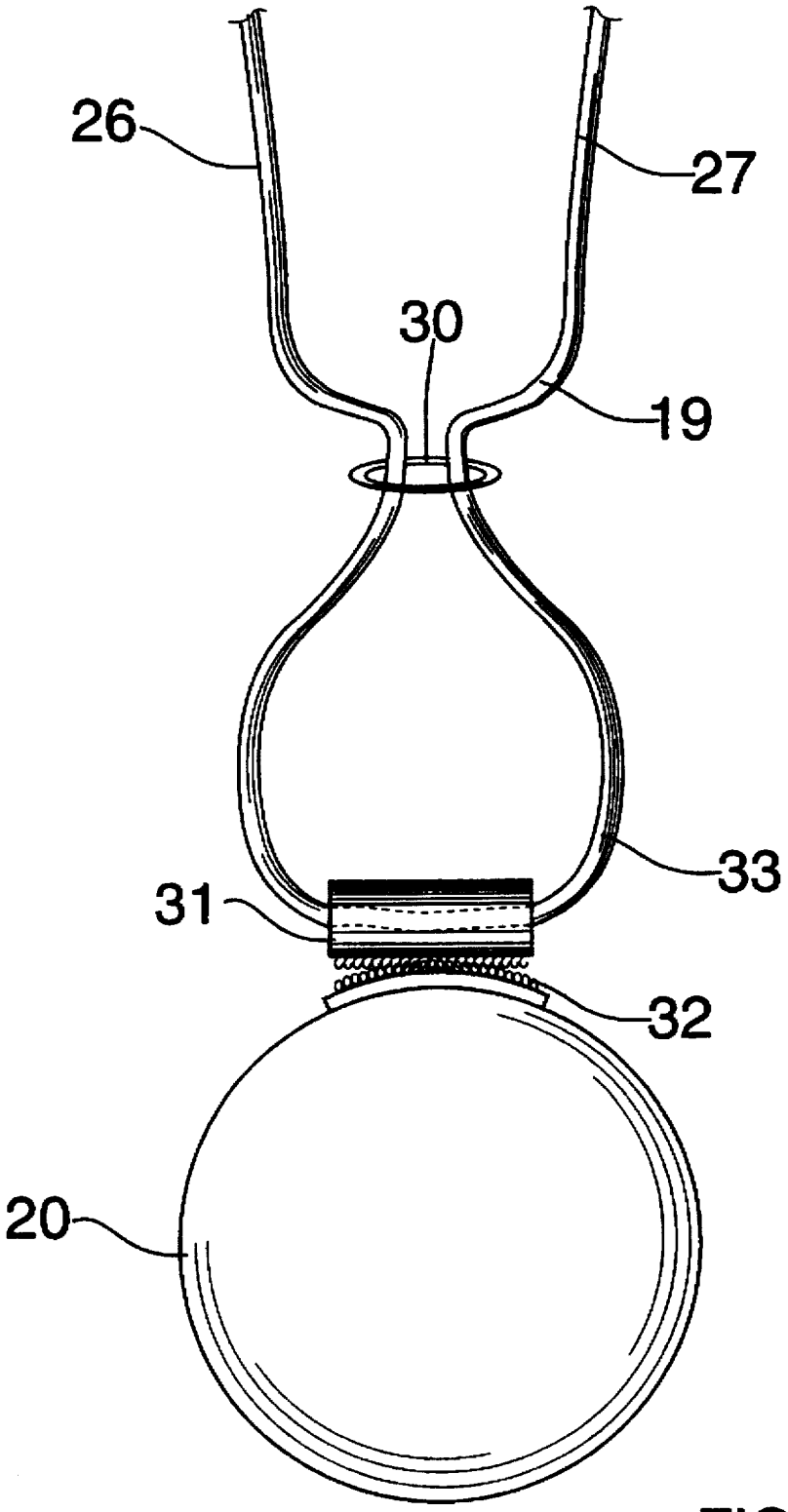
FIG. 4 illustrates one embodiment of a manner in which the baseball is releasably attached to the tether.

FIG. 4 shows a detailed view of one embodiment of a manner for attaching ball 20 to the tether 19 for use with the batting practice device. The tether 19 is threaded through a tube 31. The outside portion of tube 31 is covered with a suitable fastening material, preferably a hook and loop fastening material, such as Velcro. Tube 31 may be constructed of a nylon material or some other suitable material. Similar fastening material, again, preferably a hook and loop fastening material, 32 is attached to the top of the ball 20. The material 32 is in turn attached to tube 31 thereby releasably attaching the ball 20 to the tether 19.

The tether 19 is also threaded through a ring 30 in such a way that the two upper sections of the tether 26 and 27 are both encircled by the ring 30 and a lower portion 33 of the tether 19 vertically extends from the bottom of the ring 30. The ring 30 can be constructed of any suitable material, such as nylon, but the preferred material is rolled Velcro, which makes the ring 30 easily removable if desired. The ring 30 is vertically moveable along the lengths of sections 26 and 27. By vertically moving the ring 30 the "Y" formed by the tether 19 can be adjusted in size. For example, by moving the ring 30 down to a point just above the tube 31, the length of upper sections 26 and 27 are maximized and the ball will follow a flight path across the center of the plate when it is released.

In contrast, if the ring 30 is moved up, the length of the lower portion 33 is increased. By providing a sufficient length of the lower portion 33, the flight path of the ball can deviate from across the center of the plate. The assistant releases the ball off the center of the vertical support and on its return flight the ball will curve away from the center of the plate. This movement allows the batter to practice hitting "curves" and "screwballs". The ring 30 also allows a slight adjustment of the height of the ball if desired.

Since the tube 31 is moveable along the tether 19, gravity will cause the tube 31 (and the attached ball 20) to naturally fall to the lowest point on the lower portion 33 of the tether 19, thereby ensuring that the ball 20 is centered for the hitter. This action of the tube 31 to center the ball 20 is especially important where the tether 19 is being adjusted as discussed with reference to FIG. 6 below.

Figure 5A:
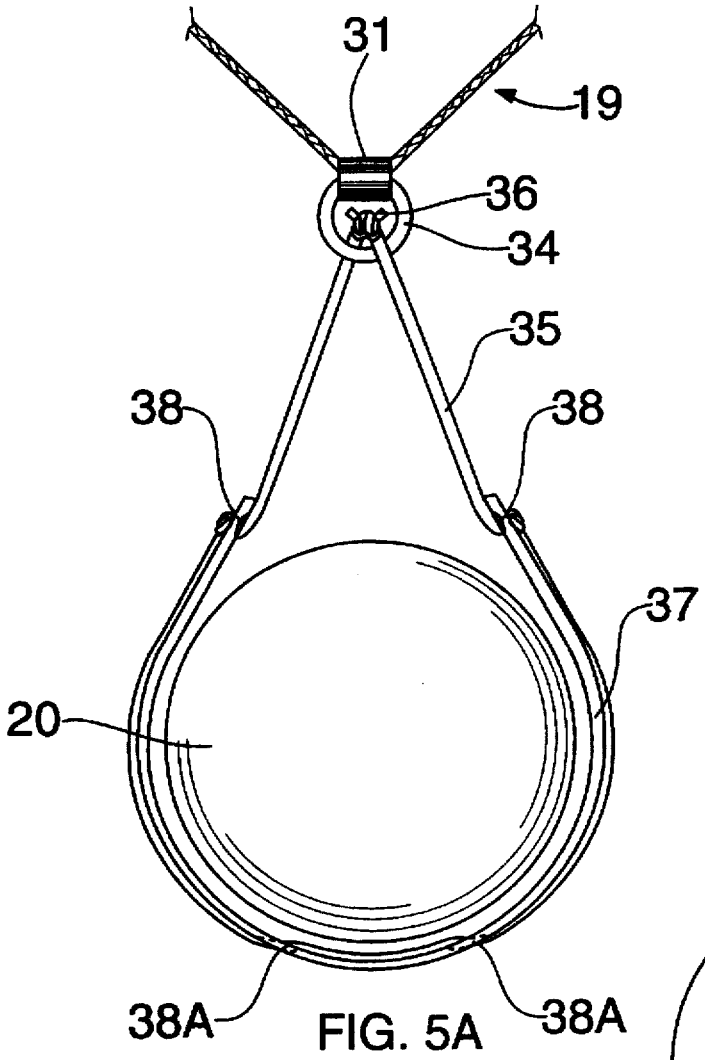
FIG. 5A illustrates a front view of a second embodiment of a manner in which the baseball is attached to the tether.
Figure 5B:
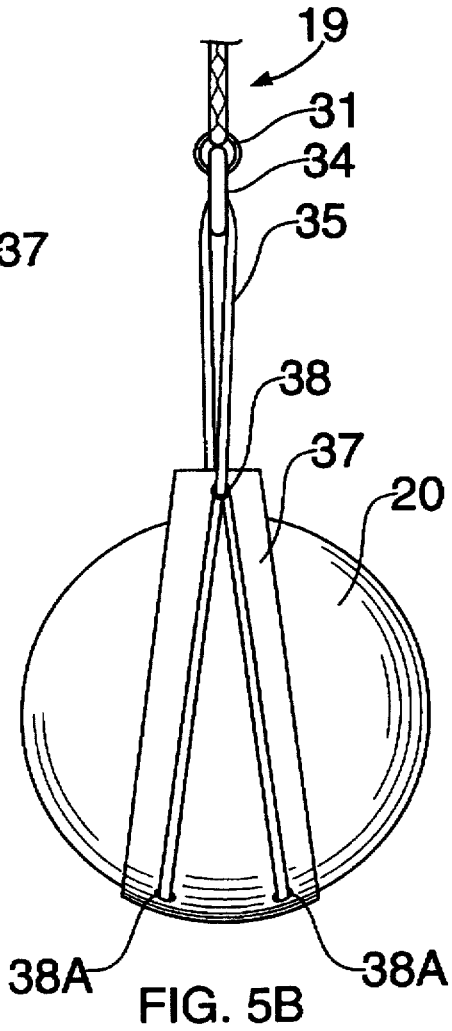
FIG. 5B illustrates a side view of the second attachment embodiment.
Figure 5C:
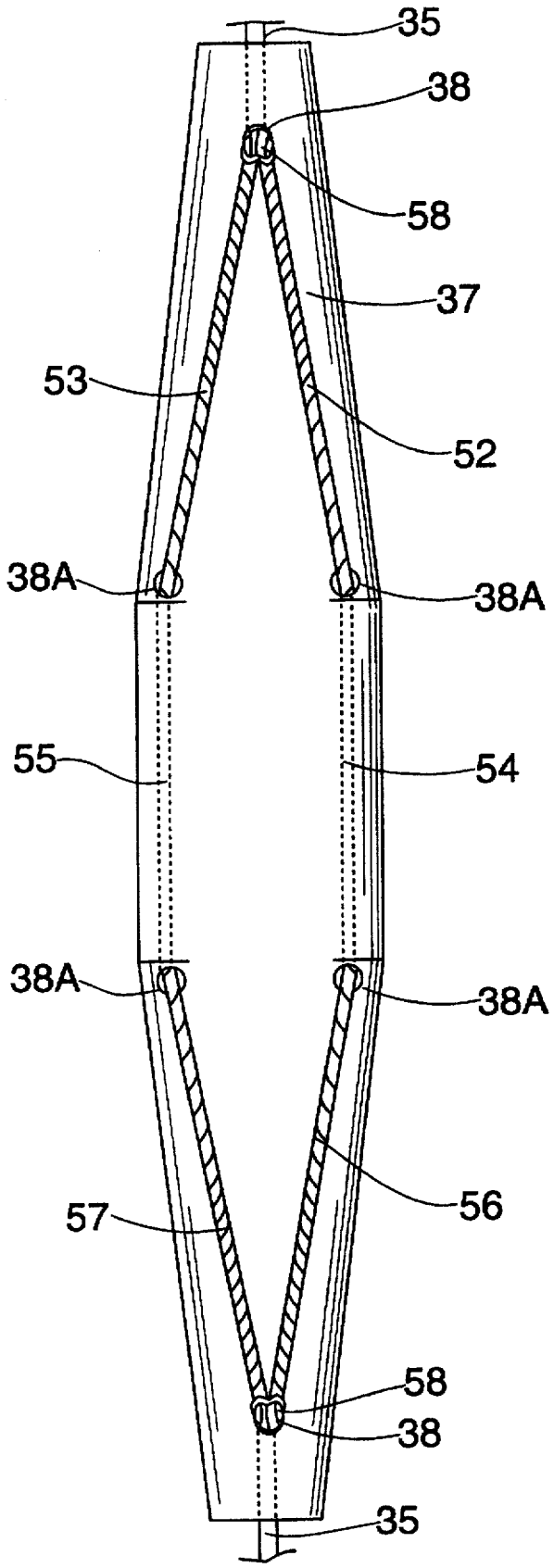
FIG. 5C illustrates a plan view of the second attachment embodiment.

FIGS. 5A, 5B and 5C show three views of another embodiment for attaching the ball 20 to the tether 19. In FIG. 5A the tether 19 is threaded through tube 31 as illustrated in FIG. 4. The tube 31 also encloses a ring 34, such that the ring 34 hangs down from the tube 33.

A string 35, constructed of nylon or some other suitable material, is in turn threaded through the ring 34 and then through openings 38 in each end of a pouch 37. The ends 36 of the string 35 are attached forming a closed loop. The pouch 37 is formed of leather or some other suitable material and is of sufficient size for releasably holding the ball 20 for presentation to the batter. In a preferred embodiment, as illustrated in FIG. 5B, the string 35 can be strung through the pouch 37 in a way that two portions of the string 35 act to provide further support for the ball 20. These portions of string 35 are strung through the pouch through four entry holes 38A and are stitched into the pouch 37 (illustrated in FIG. 5C).

FIG. 5C illustrates the pouch portion of the attachment means and the stringing of the pouch. String 35 is passed through holes 38 in pouch 37 such that it is separated into two strands 52 and 53. The strands 52 and 53 are strung into the pouch 37 through holes 38A and stitched into channels 54 and 55 within pouch 37. Portions 56 and 57 of the string 35 extend through the remainder of pouch 37 and are reconnected at hole 38. String 35 and its portions 52–57 act as further support for the ball 20.

Figure 6:
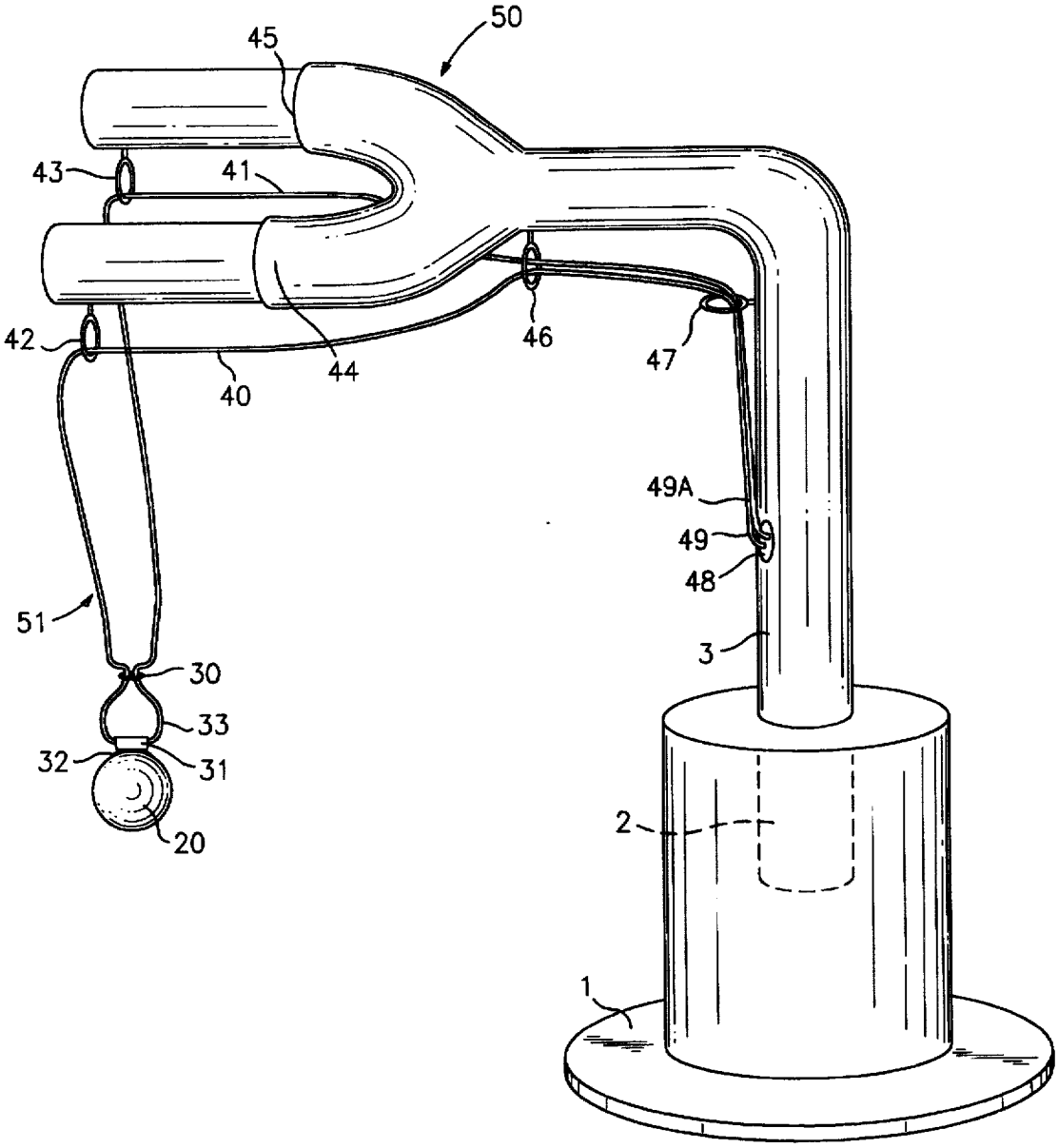
FIG. 6 illustrates a side view of a second embodiment of the baseball practice device of the instant invention.

FIG. 6 illustrates a second embodiment of the batting practice device of the instant invention. FIG. 6 illustrates the second embodiment in connection with the releasable attachment means illustrated in FIG. 4, but it is also possible to utilize the pouch means of FIGS. 5A, 5B and 5C to releasably attach the ball 20 to the device or any other embodiment of releasably attaching the ball encompassed by the appended claims of this specification.

The batting practice device of FIG. 6 consists of a vertical support mechanism such as base 1, and vertical members 2 and 3 as discussed with reference to FIG. 1. However, it will be understood that various other embodiments of the vertical support mechanism can be employed. Horizontal member 50 is a Y-shaped member which is affixed to the top of vertical member 3. It is, of course, understood that member 50 can be affixed to member 3 in a number of ways, but preferably it would rest within member 3 and be secured by various fastening means known to one skilled in the art.

The Y-shaped horizontal member 50 has two arms 44 and 45 which extend out over the batter using the device. There are eyelets or ring shaped devices 42 and 43 extending down from the bottom of the end of the arms 44 and 45. There is another eyelet 46 extending down from the bottom of horizontal member 50, preferably at the point where the arms 44 and 45 meet to form the Y. There is a final eyelet 47 extending horizontally out from vertical member 3 at a point below the attachment point of vertical member 3 and horizontal member 50.

A cord 51, is releasably attached to the ball 20 through means discussed in reference to FIGS. 4 or 5A and 5B. The cord 51 has sections 40 and 41 which are threaded individually through eyelets 42 and 43 respectively. Sections 40 and 41 are then threaded together through eyelet 46 and then together through eyelet 47. The portion of the ends 49 and **49*a* of cord 51 are releasably attached to vertical member 2 or 3 in such a way that the height of the ball 20 is raised or lowered by lengthening or shortening the cord 51. One way of attaching the ends 49 is to provide those ends with a loop and hook attachment material and to provide similar loop and hook attachment material 48 to the vertical members 2 or 3**.

The device of FIG. 6 contemplates the easy adjustment of the location of the ball 20 through at least three means. First, the vertical location of the ball 20 can be adjusted through the adjustment of vertical members 2 and 3. Further, the height of the ball 20 can be easily adjusted by moving the cord 51 and attaching the ends 49 and **49*a* of the cord 51 at various heights on the vertical members. Finally, the horizontal position of the ball can be adjusted by making the arms 44 and 45 horizontally adjustable or moving the eyelets 42 and 43** along various points along the underside of those arms.

When the height of the ball 20 is adjusted by moving the ends 49 and adjusting the location of attachment to the vertical member, the tube 31 acts to ensure that the ball 20 is centered by gravitating to the lowest point on the tether 51.

The advantage of the instant invention is due to Y-shaped member 19, which ensures that ball 20 will always return in the same flight path directly to the center of the batting practice device. Accordingly, in this manner, the player has access to attempting to hit a moving object, ball 20, but most importantly, ball 20 always returns in the same flight path such that the batter can develop his skills uniformly without the necessity for a pitcher to accurately pitch on the same flight path on every occurrence.

It is also understood that when the batter hits ball 20, the fastening attachment shown in FIG. 4 or the pouch arrangement of FIGS. 5A and 5B will release the ball, thereby allowing the ball to be propelled in the direction that it is being hit. In addition, it is possible, if necessary, to affix a string to ball 20, which string would be attached, for example, to base 1 of the baseball practice device. In this manner, as the ball is hit, it can be easily retrieved by the player by simply pulling on the string to retract the ball for replacement at the hook and loop fastening points or in the pouch for further action. In addition, it is understood that for sustained practice a plurality of balls 20 would be provided, such that the player could repetitively attach balls 20 to the Y-shaped suspension mechanism 19 and thereby hit a number of balls in succession to further perfect the skills necessary for the game of baseball.

While one embodiment of the invention and modifications thereof have been disclosed in detail, it will be understood that other embodiments and modifications are contemplated by the inventor. For example vertical members 4 and 5 could be replaced with any other type of support mechanism as well as horizontal members 6, 7 and 8. The key to the instant invention is Y-shaped mechanism 19, which ensures that ball 20 will always return on the same flight path to give the batter consistent practice in developing skills for the game of baseball. It is the intention to include all such modifications and embodiments as are defined by the appended claims within the scope of the invention.

What is claimed is:

1. A method for practicing hitting a baseball, said method comprising the steps of:

providing a batting practice, device of the type including:

a horizontal frame having at least two outwardly extending arms;

a vertical support for positioning said frame above said batter;

a tether bisected at its approximate center with a pair of portions extending upwardly from said center being attached at an end thereof to one of said arms;

a ball suspended from said frame by said tether, said ball being secured to said tether at its center; and a ring provided about the upwardly extending portions of said tether, said ring being adapted to slide up and down the portions of said tether to permit adjustment of the position of the ball relative to the frame and the movement of the ball during flight;

positioning a batter under said frame; and causing said ball to swing on said tether relative to said frame to allow the batter to hit the ball with a bat while in flight.

2. The method of claim 1, further including the step of sliding the ring up and down said tether to change the position and movement of the ball relative to the frame and to cause the ball to curve in flight.

3. The method of claim 1, wherein said ball is releasably secured to said tether and is adapted to separate from said tether upon impact of said bat and ball.

4. A baseball batting practice device for, use by a batter, said batting practice device including:

a frame including a vertical support and at least two horizontal arms extending outwardly from said vertical support;

a tether bisected at its approximate center to form a pair of opposed, upwardly extending portions;

a ball suspended from said arms by said tether and secured thereto at its approximate center; and a removable ring provided about the upwardly extending portions of said tether and adapted to slide up and down said portions to adjust the position of the ball relative to said arms and the flight path of the ball during use of said device.

5. The batting practice device of claim 4 wherein said arms are positioned relative to each other to form a "V" shaped configuration.

6. The batting practice device of claim 4, wherein said vertical support is adjustable in height.

7. The batting practice device of claim 6, wherein said vertical support includes at least two telescoping support portions to permit adjustment of the height of said vertical support.

8. The batting practice device of claim 4, wherein the length of the arms are adjustable.

9. The batting practice device of claim 4, wherein said vertical support is mounted on a base.

10. The batting practice device of claim 4, wherein said tether is a non-elastic rope.

11. The batting practice device of claim 4, wherein said tether is an elastic rope.

12. The batting practice device of claim 4, wherein the length of said tether is adjustable to permit adjustment of the distance of the ball from the at least two horizontal arms during use of the device.

13. The batting practice device of claim 4, wherein said ball is releasably secured to said tether.

14. The batting practice device of claim 13, wherein a hook and loop fastening device is provided on at least a portion of said ball which is adapted to engage a complimentary hook and loop fastening material provided on said tether.

15. The batting practice device of claim 4, further including a tubular member positioned about the center of said tether to which said ball is secured.

16. The batting practice device of claim 15, wherein said ball is releasably secured to said tubular member.

17. The batting practice device of claim 16, wherein a hook and loop fastening material is provided on at least a portion of said ball which is adapted to engage a complimentary hook and loop fastening material provided on said tubular member.

18. A baseball batting practice device for use by a batter, said batting practice device including;

a frame including two outwardly extending arms positioned in a "V" shaped configuration relative to each other and an adjustable vertical support for positioning said arms above said batter;

a tether bisected at its approximate center to form a pair of opposed upwardly extending portions;

a ball secured to said tether at its approximate center;

means for adjusting the length of the upwardly extending portions of said tether; and a removable ring provided about both of the upwardly extending portions of said tether, said ring being adapted to slide up and down said portions to permit adjustment of the position of the ball relative to the frame and the flight path of the ball during use.

19. The batting practice device of claim 18, further including a tubular member positioned about the center of said tether to which said ball is releasably secured.

20. A baseball batting practice device for use by a batter, said batting practice device including:

a frame having two outwardly extending arms positioned in a "V" shaped configuration relative to each other and attached to an adjustable vertical support for positioning said arms above said batter;

a tether bisected at its approximate center to form a pair of opposed upwardly extending portions;

a ball releasably secured to said tether at its approximate center;

a ring provided about the upwardly extending portions of said tether, said ring being adapted to slide up and down said portions to permit adjustment of the position of the ball relative to the arms and the flight path of the ball during use; and a tubular member secured to said tether to which said ball is releasably secured.

* * * * *